United States Patent [19]

Venus

[11] Patent Number: 4,629,423

[45] Date of Patent: Dec. 16, 1986

[54] SIDEWALL INSULATION OF A CHAMBER TYPE FURNACE FOR BAKING CARBON BLOCKS

[75] Inventor: Willem Venus, Spykenisse, Netherlands

[73] Assignee: Swiss Aluminium Ltd., Chippis, Switzerland

[21] Appl. No.: 818,697

[22] Filed: Jan. 14, 1986

[30] Foreign Application Priority Data

Jan. 30, 1985 [CH] Switzerland ..... 407/85

[51] Int. Cl.[4] ..... F27D 1/00

[52] U.S. Cl. ..... 432/247; 432/251; 110/336

[58] Field of Search ..... 432/192, 247, 251; 110/336

[56] References Cited

U.S. PATENT DOCUMENTS 1,341,594 5/1920 Schweyer ..... 110/336

3,448,971 6/1969 Renkey ..... 432/247

FOREIGN PATENT DOCUMENTS 114751 4/1918 United Kingdom ..... 432/247

*Primary Examiner*—Henry C. Yuen

*Attorney, Agent, or Firm*—Bachman & LaPointe

[57] ABSTRACT

The region between the outermost firing shaft and the outer wall of a chamber type furnace for baking carbon blocks, in particular anodes for the fused salt electrolytic production of aluminum, comprises essentially at least one layer each of firebricks as the wall of the outermost firing shaft, insulating refractory foamed bricks and moler stone or calcium silicate bricks at the outer wall of the furnace. The layer of insulating, refractory foamed bricks is fixed to the outer wall without room for play. Sealing elements on a projection of the outer wall extending over but at a distance from the insulating layers and on the outermost firing shaft interlock with one another.

13 Claims, 3 Drawing Figures

SIDEWALL INSULATION OF A CHAMBER TYPE FURNACE FOR BAKING CARBON BLOCKS

BACKGROUND OF THE INVENTION

The present invention relates to sidewall insulation in the region between the outermost firing shaft and the outer wall of a chamber type furnace for baking carbon blocks, in particular anodes for the production of aluminum by the fused salt electrolytic process.

Chamber type furnaces for baking carbon blocks, used in particular as anodes in the electrolytic production of aluminum, have been known for many years. These comprize a plurality of chambers which are arranged in rows and are either built into the ground or directly on the ground. Between the baking chambers which hold the carbon blocks are firing shafts. The chambers are mostly vertical and, depending on their mode of construction, are either open at the top or are closed off there by removable lids.

In the production of the carbon blocks a doughy mixture is shaped into the form of blocks either in a press or in a vibration machine. The green strength carbon blocks are then transferred to the baking furnace where they are stacked in the baking chambers or pits and packed into a bed of coke or anthracite powder. Following this the baking chambers are then sealed off so as to be almost air tight. The packing in the carbonaceous powder prevents oxidation of the carbon blocks during the baking process. The heating is performed using gas, oil or electrical energy.

The baking process lasts several days, during which the temperature of the carbon blocks is for a specific time above 1100° C. It is therefore necessary to take special measures to limit energy losses and to prevent the region immediately next to and around the furnace from being exposed to strong heating. For this reason it is normal to construct the furnace with relatively thick walls and floor using refractory, thermally insulating ceramic material.

Known from the Austrian Pat. No. 261 723 is a chamber type furnace with thick sidewall insulation of firebrick which has a high thermal capacity. On heating the furnace to operating temperature this thick firebrick insulation produces a pressure on the firing shaft as a result of which the latter can even be displaced from its vertical position.

FIG. 1 shows a partical vertical section through a chamber type furnace of another known form. A shell comprizing a base 10 and an outer wall 12 of concrete is fitted with a multilayered construction of firebricks 14 and sidewall insulation for example of foamed bricks 16 or other insulating bricks (in the following for simplicity referred to simply as foamed bricks). After a thick sidewall layer of firebricks 14 is the outermost firing shaft 18 which features a thinner wall of firebricks 14 on the side towards the interior of the furnace. After the first anode pit 20 in which the green strength carbon blocks are stacked, comes a normal firing shaft 22 which is walled on both sides with a thin wall of firebricks 14. The uppermost region of the furnace is protected by cover plates 24.

In the version of chamber furnace shown in FIG. 1 there are two types of firing shafts viz.; the lighter normal shaft 22 and the heavier outermost shaft 18 which is neighbored to the outer wall 12.

The object of the present invention is to develop a sidewall insulation for the region between the outermost firing shaft and the outer wall of a chamber type furnace for baking carbon blocks, in particular anodes for the fused salt electrolytic production of aluminum, such that the said insulation exhibits a higher degree of efficiency and longer service life, and this using conventional designs, and incurring comparable expenditure for labor and material.

SUMMARY OF THE INVENTION

The foregoing object is achieved by way of the invention chararcterized by way of:

(1) the arrangement of at least one layer each of firebricks as the wall of the outermost firing shaft, insulating refractory foamed bricks and moler or calcium silicate bricks at the outer wall of the furnace, (2) a projection of the outer wall which projects over the insulating layers at a distance from the same, with the space between filled with a compressible refractory insulating material, and elements which engage with each other and seal off the gap between the projection and the outermost firing shaft, and (3) the layer of insulating, refractory foamed brick being fixed to the outer wall without room for play.

According to a first feature of the invention therefore the thick layers of refractory bricks with a density of about 2.1 g/cm$^3$ are for the greater part replaced by insulating material having a density of 0.5 g/cm$^3$ and smaller thermal capacity and/or likewise lighter moler stone (density 0.63 g/cm$^3$). At a smaller price per unit volume for the insulating material a much better temperature curve for insulation is obtained, thanks to the smaller thermal capacity of the foamed brick material. The temperature falls away faster in the insulating material than in the firebrick with the larger thermal capacity. As a result the furnace shell, which is mostly made of concrete and therefore withstands temperatures above 100° C. relatively poorly, is to a large extent protected—which increases its service life considerably.

According to another feature of the invention the region between the outer wall of the furnace and the outermost firing shaft is completely sealed off. This region comprizes the layer/layers of refractory foamed insulating bricks and the layer/layers of moler stone bricks.

The last claimed feature of the invention viz., the fixing of the insulating, refractory foamed bricks on to the outer wall without a space between is of considerable importance. If this fixing is omitted, experience shows that in the course of time material (e.g. coke and anthracite powder) penetrate in between the insulation and the concrete shell as a result of which the insulation is irreversibly pressed inwards. Apart from the securing function the fixing according to the invention has the basic advantage that, as maintenance work is performed on the firing shaft, the sidewall insulation is not damaged or torn out. The metallic means of fixing does indeed conduct some heat outwards, but this is not of great significance for the overall energy balance of the furnace.

Materials employed for the insulating refractory brickwork are both foamed bricks and high duty furnace bricks (German = Ausbrandsteine) and moler stone bricks.

For the sidewalls of the outermost firing shaft one employs preferably a 90–150 mm thick, in particular 110–120 mm thick layer of firebrick. The layer/layers immediately next to this is/are of insulating, refractory foamed bricks, in total preferably 230–400 mm thick, in particular 300–359 mm thick. The layer/layers of moler stone or calcium silicate bricks immediately next to the outer wall is/are in total preferably 200–300 mm thick, in particular 240–260 mm thick. The exact values for the thickness of the individual layers used in practice stem essentially from the standard dimensions of the bricks in question; only the approximate thickness values are determined by calculation.

The projection jutting over the insulating layer of refractory foamed bricks and moler stone or calcium silicate bricks, and at a distance from the same, is preferably a nose-shaped mass of concrete. In the case of existing chamber type furnaces this is usefully mounted on the existing concrete wall and secured there. When constructing a new chamber type furnace on the other hand the concrete nose is then constructed together with the outer wall as one piece.

The space between the projection and the above mentioned insulating layers is usefully filled with slag or silicate wool.

The sealing elements of the projection and the outermost firing shaft engage with each other and are usefully designed such that the projection features a steel section which is U-shaped in cross-section. In the uppermost region of the outermost firing shaft or its cover an L-shaped steel section is attached in such a manner that the free flange of that section, after insertion into the U-shaped section, runs vertically downwards. The sealing action of the interlocking steel sections can be improved further by insertion of a sealing material between them.

The fixing of the insulating, refractory foamed bricks on the outer wall is performed preferably using steel anchoring means which pass through the layer/layers of moler stones or calcium silicate bricks. The securing of the steel anchoring means in the foamed brick layer can be achieved for example by concrete blocks embedded in that layer at the appropriate place.

The advantages of the furnace sidewall insulation according to the invention can be summarized as follows:

(1) The specific energy consumption is reduced as a result of the smaller heat capacity.

(2) There is no difference in quality between carbon blocks calcined in the outermost chamber or those calcined in a normal chamber of the furnace.

(3) The investment costs for the refractory materials are smaller.

(4) The costs involved in replacing the outermost firing shaft are reduced by more than half thanks to the thinner layer of refractory bricks and the foamed bricks fixed to the outer wall of the furnace.

BRIEF DESCRIPTION OF THE DRAWINGS

The invention is explained in greater detail in the following detailed description using by way of example the schematic vertical sections in the accompanying figures wherein.

DETAILED DESCRIPTION

Figure 2:
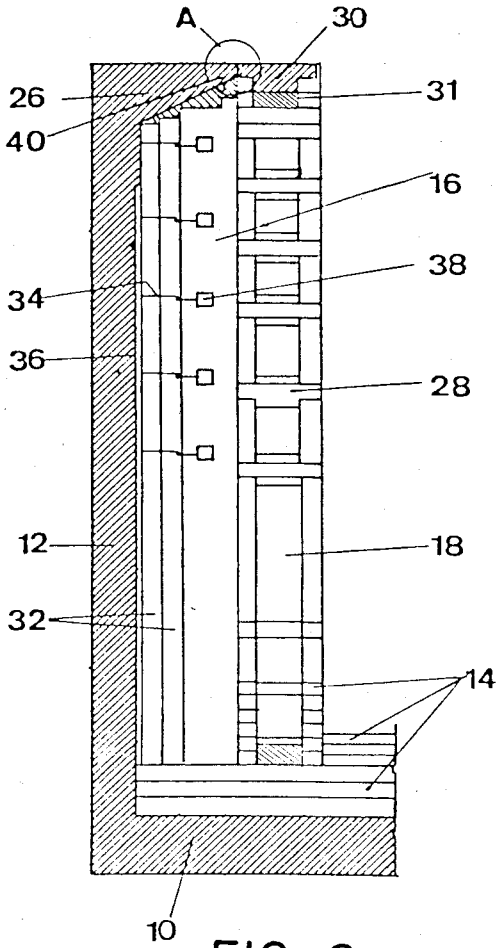
FIG. 2 is an end part of a chamber type furnace.
Figure 1:
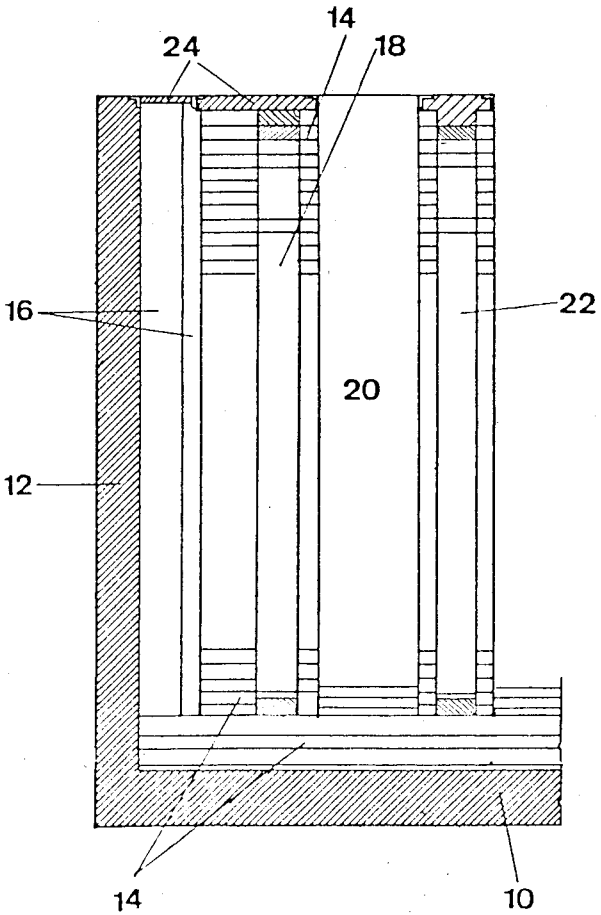
FIG. 1 is a partial section through a prior art chamber type furnace.

The sectioned part of a chamber type furnace in FIG. 2 shows the concrete base 10 which forms a part of the shell and the outer wall 12 which is also made of concrete; these are similar to the known version of this type of furnace. The outer wall 12, however, features at its uppermost part a nose 26 which forms an outward projecting collar, is in one piece and likewise made of concrete, and extends right over to the outermost firing shaft 18.

The sidewalls of the outermost firing shaft 18 are held an exact distance apart by holding or supporting bricks 28. A cover plate 30 with the usual insulation 31 closes off the outermost firing shaft 18. This outermost shaft 18 is designed exactly like all the other normal firing shafts.

On the base 10 is a plurality of layers 14 of firebricks, of which the walls of the firing shafts are also made.

Between the outermost firing shaft 18 and the outer wall 12 is firstly a layer of insulating, refractory foamed bricks 16, then two layers of moler stone or calcium silicate bricks 32.

Mounted securely in the outer wall 12 on a vertical section 36 are steel anchoring pieces 34 which penetrate the layers of moler stone bricks 32, pass into the layer of foamed brick 16 and are secured there in concrete blocks 38.

The space between the concrete nose 26 and the insulating layers of foamed bricks 16 and moler stone bricks 32 is filled with slag or silicate wool 40.

Figure 3:
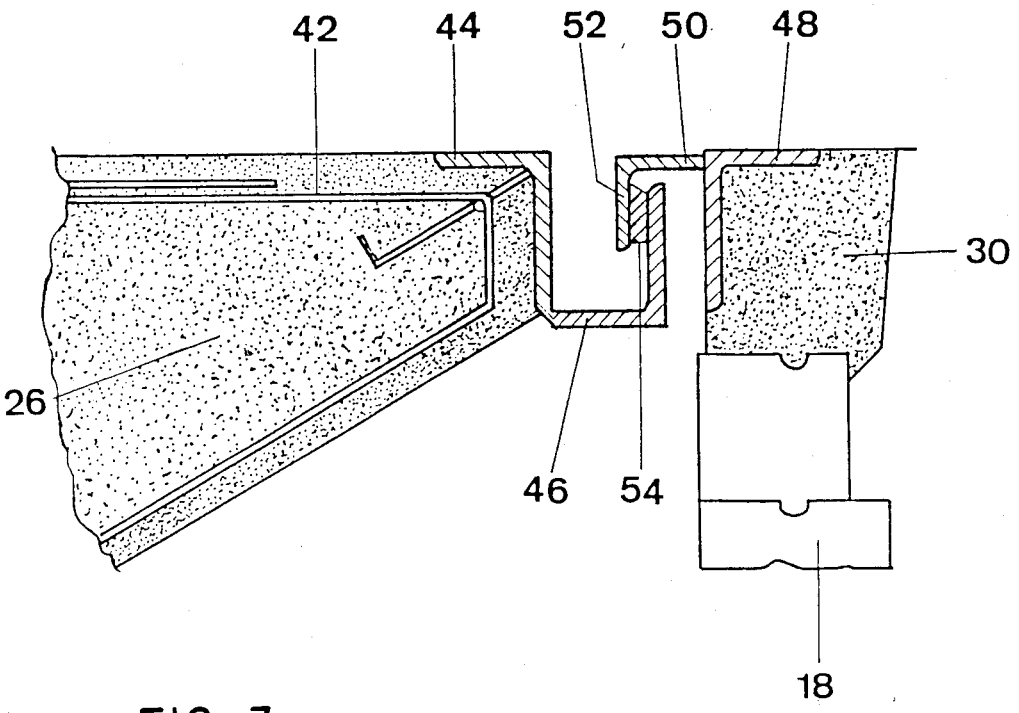
FIG. 3 is a sealing element for the projection and the outermost firing shaft.

The sealing elements of the concrete nose 26 and the outer firing shaft 18, in region A in FIG. 2, are shown on a larger scale in FIG. 3. The concrete nose 26 with its reinforcement 42 is secured to a steel U-shaped section 46 via flange 44. An L-shaped steel section 50 is welded on to an angle piece 48 belonging to the cover plate 30 of the outer firing shaft 18, and is such that its free leg 52 points vertically downwards and engages in the U-section 46 of the concrete nose 26. Between the two engaging steel sections 46, 50 is a sealing mass 54 of a flexible material e.g. asbestos-free, refractory mesh.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A chamber open-ring type furnace for baking carbon blocks having an outer wall defining a chamber divided into a plurality of firing shafts, the improvement which comprises insulation in the region between the outermost firing shaft and the outer wall, said insulation comprising at least one layer of refractory foamed bricks abutting the outermost firing shaft and at least one layer of insulating bricks made of a material selected from the group consisting of moler stone and calcium silicate abutting the insulating refractory foamed bricks and the outer wall, said outer wall having a projection which projects over said insulation at a spaced distance therefrom wherein the space between the projection and said insulation is filled with a compressible refractory insulating material and sealing means for sealing between the projection and the outermost firing shaft.

2. A furnace according to claim 1 wherein the at least one layer of refractory foamed bricks is 230–400 mm thick and the at least one layer of insulating bricks is 200–300 mm thick.

3. A furnace according to claim 1 wherein the at least one layer of refractory foamed bricks is 300–350 mm thick and the at least one layer of insulating bricks is 240–260 mm thick.

4. A furnace according to claim 1 wherein the projection is concrete.

5. A furnace according to claim 4 wherein the projection is formed in one piece with the outer wall.

6. A furnace according to claim 1 wherein the space between the projection and the insulation is filled with slag.

7. A furnace according to claim 1 wherein the sealing means between the projection and the outermost firing shaft are interlocking U- and L-shaped steel sections.

8. A furnace according to claim 7 wherein a sealing material is provided between the steel sections.

9. A furnace according to claim 1 wherein the at least one layer of refractory foamed bricks is fixed to the outer wall by steel anchoring pieces which pass through the at least one layer of insulating bricks.

10. A furnace according to claim 9 wherein the steel anchoring means are secured in the foamed brick by means of concrete blocks.

11. A furnace according to claim 1 wherein the space between the projection and the insulation is filled with silicate wool.

12. A furnace according to claim 1 wherein said outermost firing shaft comprises at least one layer of fire bricks 90–150 mm thick.

13. A furnace according to claim 1 wherein said outermost firing shaft comprises at least one layer of fire bricks 110–120 mm thick.

* * * * *